United States Patent [19]

Slee

[11] Patent Number: 4,522,161

[45] Date of Patent: Jun. 11, 1985

[54] VALVE SEAT INSERTS

[75] Inventor: Roger H. Slee, Warwick, England

[73] Assignee: AE PLC, Rugby, England

[21] Appl. No.: 530,682

[22] Filed: Sep. 9, 1983

[30] Foreign Application Priority Data

Sep. 11, 1982 [GB] United Kingdom ..... 8225966

[51] Int. Cl.[3] ..... F01L 3/22

[52] U.S. Cl. ..... 123/41.85; 123/188 S; 123/188 GC; 29/156.7 A

[58] Field of Search ..... 123/41.85, 41.76, 41.77, 123/188 GC, 188 S; 29/156.7 A

[56] References Cited

U.S. PATENT DOCUMENTS 3,170,452 2/1965 Dobovan ..... 29/156.7 A
4,147,149 4/1979 Andrea ..... 123/41.77
4,169,488 10/1979 Goloff et al. ..... 123/188 GC

FOREIGN PATENT DOCUMENTS 867053 9/1941 France ..... 123/41.85

*Primary Examiner*—William A. Cuchlinski, Jr.
*Attorney, Agent, or Firm*—Leydig, Voit, Osann, Mayer & Holt, Ltd..

[57] ABSTRACT

A water-cooled internal combustion engine has at least one cylinder and a valve controlled exhaust port (11). A valve seat insert (17) is provided around the entrance to the port and is formed with a sealed passage (24) therearound which is in direct communication with the water-cooling system. Water is thus circulated around the passage to cool the valve seat insert and the associated valve.

9 Claims, 4 Drawing Figures

VALVE SEAT INSERTS

BACKGROUND TO THE INVENTION

1. Field of the Invention

The invention relates to valve seat inserts, to water-cooled internal combustion engines including such valve seats and to methods of manufacturing such engines.

2. Review of the Prior Art

A known valve seat insert and its arrangement in a water-cooled internal combustion engine is shown in FIG. 1 of the drawings which is a schematic cross-sectional view through an exhaust port of an internal combustion engine. The water-cooled internal combustion engine comprises at least one cylinder 10 and a valve controlled exhaust port 11 communicating with the cylinder 10. The exhaust port 11 is formed by a wall of a casting 12 which is commonly of cast iron or aluminium alloy. An exterior surface 13 of the casting defines a portion of the combustion chamber 10 and also forms the walls of the exhaust port 11. An interior surface 14 of the casting 12 defines a section of the water-cooling system of the engine to allow water 15 to circulate round the cylinder 10 and the exhaust port 11.

The casting is formed with an annular rabbet 16 around the end of the exhaust port 11 and an annular valve seat insert 17 is received in the rabbet. The valve seat insert 17 is made from a material better able than the cast iron or the aluminium alloy of the casting 12 to withstand the temperatures and impacts encountered in the hot exhaust gases as they pass into the port. The valve seat insert 17 has the usual bevelled annular seating surface 18 for engagement with a head of the valve.

Due to the high temperatures encountered in the combustion chamber 10 and in the exhaust gases passing into the exhaust port 11, the valve head and the valve seat reach elevated temperatures. For example, the surface 19 of the valve seat insert 17 which faces the cylinder 10 can reach a temperature of about 400° C. and the valve-engaging surface 18 may reach a temperature of about 480° C. Correspondingly higher temperatures are attained in the valve itself, with the edge of the valve head reaching, for example, about 550° C. and the centre of the valve head reaching as much as about 800° C. This has a number of disadvantages. It requires the valve to be made of expensive alloys such as cobalt-including alloys, particularly where the engine is a high specific output gasoline or turbo-charged diesel engine, where especially high temperatures are encountered. It can also cause valve burn-out and may eventually cause the valve seat 17 to drop out of the rabbet 16. In addition, the valve head and the valve seat insert may act as a 'hot spot', so inducing detonation and pre-ignition in a gasoline engine.

SUMMARY OF THE INVENTION

According to a first aspect of the invention, there is provided a water-cooled internal combustion engine comprising at least one cylinder and valve-controlled inlet and exhaust ports communicating with said cylinder, at least one said ports including an annular valve seat insert fitted in an annular rabbet, the valve seat insert being provided with a passage extending therearound and opening on to the rabbet, the rabbet communicating with the water-cooling system of the engine to allow water to flow to, through, and out of the passage, so cooling the valve seat insert and an associated valve.

According to a second aspect of the invention, there is provided a valve seat insert for a water-cooled internal combustion engine and comprising an annular body having two adjacent annular surfaces which are normal to one another and which fit into a corresponding rabbet in the engine, a passage extending around the valve seat insert and opening onto one of said insert surfaces for the flow of engine cooling water through said passage.

According to a third aspect of the invention, there is provided a method of manufacture of a water-cooled internal combustion engine of the kind comprising at least one cylinder having valve-controlled inlet and exhaust ports communicating with said cylinder, the method comprising casting a portion of the engine with a port and with passages for cooling water, forming said casting with an annular rabbet which communicates with the cooling water passage, and then fitting in said rabbet a valve seat insert according to the second aspect of the invention.

BRIEF DESCRIPTION OF THE DRAWINGS

The following is a more detailed description of one embodiment of the invention, by way of example, reference being made to the accompanying drawings in which.

DESCRIPTION OF THE PREFERRED EMBODIMENTS

Figure 1:
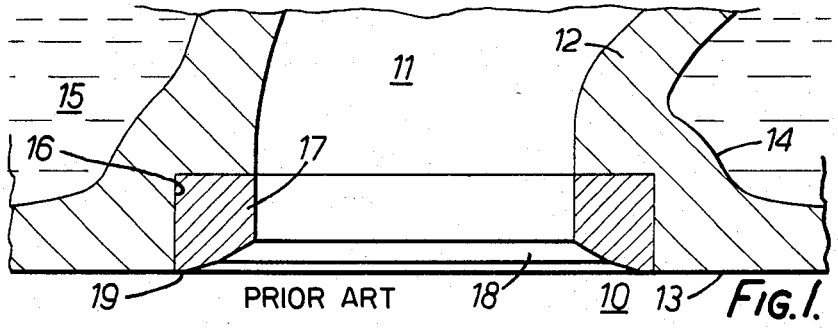
FIG. 1 is a schematic cross-sectional view through an exhaust port of an internal combustion engine.

Parts common to FIG. 1 and to FIGS. 2, 3 and 4 will be given the same reference numerals and will not be described in detail.

Figure 2:
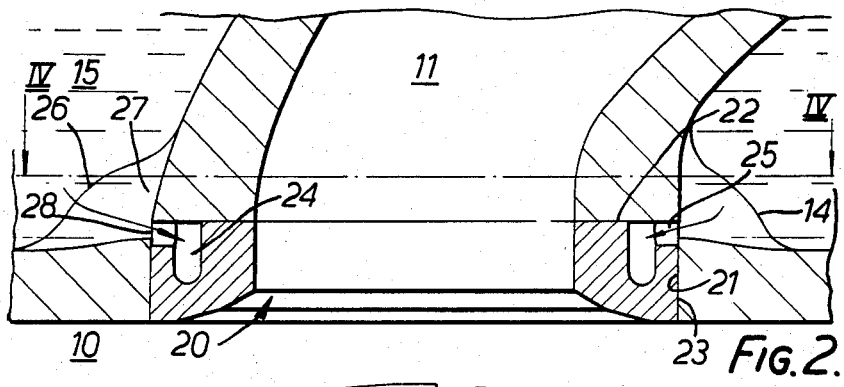
FIG. 2 is a diagrammatic cross-sectional view through an exhaust port of a water-cooled internal combustion engine and including a valve seat insert.
Figure 3:
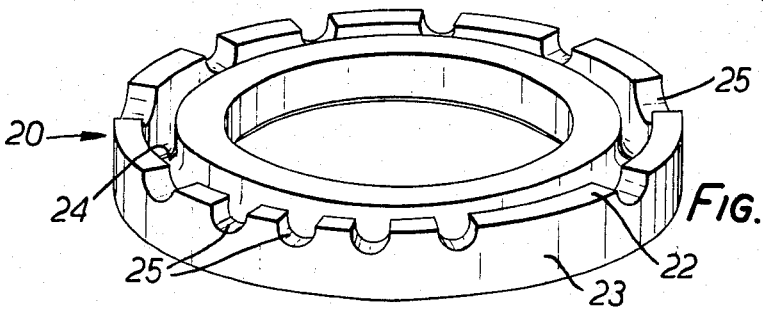
FIG. 3 is a perspective view of the insert of FIG. 2.
Figure 4:
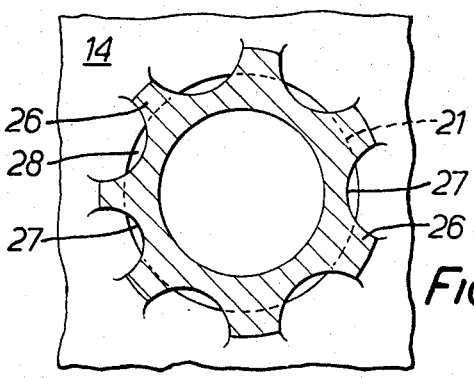
FIG. 4 is a schematic section on the line IV—IV of FIG. 2.

Referring first to FIGS. 2 and 3, the insert 20 is received in a rabbet 21 provided around the entrance to the exhaust port 11 leading from the cylinder 10 of a water-cooled internal combustion engine. The insert 20 may be formed by casting or sintering from a heat-resistant material such as an iron-based material.

The insert 20 has two mutually perpendicular rabbet-engaging surfaces 22, 23; one, 2, lying in a plane normal to the axis of the insert 20 and the other, 23, being coaxial with this axis. One surface 22 is provided with an annular channel 24 extending therearound. The other surface 23 is provided with a plurality of angularly spaced U-shaped notches 25 which lead from the channel 24 to the surface 23 and are formed in the edge between the two surfaces 22, 23.

The rabbet 21 is formed as follows.

The portion of the engine including the exhaust port 11 is cast from iron or aluminium alloy. The mould is arranged to shape the outer wall 13 of the casting to form part of the surface of the combustion chamber 10 and an entrance to the inlet port 11, without the rabbet 21 being formed at this stage. The inner surface 14 of the casting is formed, as best seen in FIG. 4, with an annularly spaced succession of projections 26 and depressions 27 in that part of the casting in which the rabbet 21 is to be formed. The projections and depressions 26, 27 are so formed that when the rabbet 21 is machined in the casting, the edge between the two surfaces 22, 23 of the rabbet 21 cuts through the depressions 27, as seen in FIG. 4. In this way, a succession of angularly spaced apertures 28 are formed which lead from the rabbet through the surface 14 into the cooling water passage. The rabbet 21 and the insert 20 are so dimensioned that the insert 20 is an interference fit in the rabbet 21. Before insertion into the rabbet 21, however, an 'O' ring or a shim seal of polytetrafluorethylene or other heat-resistant material is placed over the insert surface 22 to form a seal between this surface and the co-operating rabbet surface after insertion of the insert 20 into the rabbet 21.

The number and arrangement of the rabbet apertures 28 and the number and arrangement of the insert apertures 25 are such that, whatever the angular orientation of the insert 20 relatively to the rabbet 21, at least four of these apertures are in communication with one another. This means that there is no need to worry about insert orientation when the insert is fitted into the rabbet.

In use, the water circulating through the engine cooling system passes in through some of the apertures 25, 28, circulates around the channel 24 and leaves by other of the apertures 25, 28. This ensures that the temperature in that part of the insert 20 around the channel is at or around 100° C. and leads to a dramatic reduction in the temperature of the insert at the surfaces 18, 19 and also to a dramatic reduction in the valve head temperatures. For example, the temperature at the surface 18 may be as low as 200° C. and the temperature at the surface 19 may be as low as 350° to 400° C. The edge of the valve head may be only at 400° C. and the centre of the valve head at 600° C. This has a number of important advantages. First, it does not require the use of high grade alloys in the formation of the valve thus reducing the cost of the valve. It increases the burn-out resistance of the valve seat insert under overload. It allows particular resistance to the 'hot spot' conditions found in high-specific output and turbo charged gasoline engines. In addition, it eliminates valve seat drop-out due to relaxation of the material during engine operation.

The valve seat insert 21 described above with reference to the drawings can be cheaply and easily produced. The casting required is relatively simple and adds little to the expense of production of the engine. The shape of the channel 24 and of the apertures 25 is such that the water passes through the channel 24 with a scouring action which discourages clogging and scale formation.

It will be appreciated that the valve seat insert 20 described above with reference to the drawings may be varied in a number of ways. For example, the passage for water need not be formed by an open channel 24, it could be formed by a closed passage having apertures extending to the rabbet. More than one channel may be provided and the way in which the cooling water reaches the insert may be arranged to be in any suitable way and is not necessarily limited to that described above. The formation of the apertures 28 in the casting need not be by the method described above. It may be by any other suitable method such as drilling.

Although the greatest benefits are secured by using the insert described above in an exhaust port, it will be appreciated that benefits may also arise as a result of its use in an inlet port.

I claim:

1. A water-cooled internal combustion engine comprising at least one cylinder and valve-controlled inlet and exhaust ports communicating with said cylinder, at least one of said ports including an annular valve seat insert fitted in an annular rabbet, the rabbet communicating with the water-cooling system through apertures provided therein, the valve seat insert being provided with a passage extending therearound and opening on to the rabbet, the passage communicating with the water-cooling system of the engine through apertures provided in the valve seat insert and said apertures provided in the rabbet to allow water to flow to, through, and out of the passage, so cooling the valve seat insert and an associated valve, the number and arrangement of the rabbet apertures and the valve seat insert apertures being such that at least four rabbet apertures and valve seat apertures are in communication, whatever the angular disposition of the valve seat insert relatively to the rabbet.

2. An engine according to claim 1 wherein the passage is formed as a channel provided in one rabbet-facing surface of the valve seat insert.

3. An engine according to claim 2 wherein the channel is closed by a co-operating surface of the rabbet and wherein said valve seat apertures are provided in the other rabbet-engaging surface of the valve seat insert.

4. An engine according to claim 2, wherein the channel is provided in a surface of the valve seat insert which lies in a plane normal to the axis of the valve seat insert.

5. An engine according to claim 4 wherein a seal is provided between the valve seat insert surface including said channel and the associated rabbet surface.

6. An engine according to claim 1 wherein the passage is in the form of a closed bore extending around the valve seat insert and wherein said apertures connect said closed bore to the rabbet.

7. A valve seat insert for a water-cooled internal combustion engine and comprising an annular body having two adjacent annular surfaces which are normal to one another and which fit into a corresponding rabbet in the engine, a channel provided in one of said insert surfaces extending around the valve seat insert and being closed by an associated rabbet surface, and angularly spaced U-shaped notches extending from an edge between said two insert surfaces to said channel and opening onto one of said insert surfaces for the flow of engine cooling water through said passage.

8. A method of manufacturing of a water-cooled internal combustion engine of the kind comprising at least one cylinder having valve-controlled inlet and exhaust ports communicating with said cylinder, the method comprising casting a portion of the engine with a port, with passages for cooling water and with a part in which a rabbet is to be formed for receiving a valve seat insert, the rabbet-forming part of the casting being annular with a continuous outer surface in which the rabbet is formed and an inner surface forming a surface of the cooling water passage, the inner surface being cast with an angularly-spaced succession of projections and depressions therearound, such that the edge between two surfaces defining the rabbet, when formed, passes through the depressions to form, between adjacent projections, apertures leading into the rabbet, forming said casting with said rabbet and then fitting in said rabbet a valve seat insert including an annular body having two adjacent annular surfaces that are normal to one another and which engage said rabbet surfaces, and a passage extending around the valve seat and opening onto one of said insert surfaces to communicate with said rabbet apertures for the flow of cooling water therethrough.

9. A method according to claim 8 and in which the valve seat insert is provided with apertures, wherein the arrangement of the depressions and projections and the arrangement of the valve seat insert apertures is such that at least four rabbet apertures and valve seat apertures are in communication whatever the angular disposition of the valve seat insert relatively to the rabbet.

* * * * *